United States Patent [19]

Giles

[11] Patent Number: 4,991,355

[45] Date of Patent: Feb. 12, 1991

[54] APPARATUS FOR SHARPENING POINTS

[76] Inventor: John E. Giles, 8614 Tarpon Springs Rd., Odessa, Fla. 33556

[21] Appl. No.: 345,836

[22] Filed: May 1, 1989

Related U.S. Application Data

[60] Division of Ser. No. 176,213, Mar. 31, 1988, and a continuation-in-part of Ser. No. 176,213, Mar. 31, 1988, Pat. No. 4,869,028, which is a division of Ser. No. 73,572, Jul. 15, 1987, Pat. No. 4,879,844.

[51] Int. Cl.[5] ..... B24B 19/16

[52] U.S. Cl. ..... 51/90; 51/98 BS; 51/73 R; 51/170 MT

[58] Field of Search ..... 51/90, 98 R, 98 BS, 51/73 R, 170 MT; 144/28.6, 28.7, 28.72

[56] References Cited

U.S. PATENT DOCUMENTS

| | | | |
|---|---|---|---|
| 1,079,312 | 11/1913 | Chadwick | 144/28.7 |
| 2,181,285 | 11/1939 | Schuler | 51/90 |
| 2,851,009 | 9/1958 | Branvold | 51/73 |
| 3,092,081 | 6/1963 | Fraser | 51/98 R |
| 3,224,146 | 12/1965 | Ahlstrom | 51/90 |
| 3,340,651 | 9/1967 | Ahlstrom | 51/33 |

FOREIGN PATENT DOCUMENTS

| | | | |
|---|---|---|---|
| 0135541 | 4/1952 | Sweden | 144/28.72 |

OTHER PUBLICATIONS

Bass Pro Shops, Springfield, Mo., 1980, Fish Hook Sharpener.

*Primary Examiner*—Robert A. Rose
*Attorney, Agent, or Firm*—Charles M. Kaplan

[57] ABSTRACT

A needle sharp conical point can be quickly honed by methods and apparatus that employ reciprocating or rotating abrasive surfaces that may be revolved in a circle around the point being sharpened. A reciprocating surface may be used to hone non-conical points. The size and shape of the points may be adjusted by changing the location at which the moving abrasive surface intersects the axis of the point. Examples of hand held, portable, self energizing apparatus are disclosed.

41 Claims, 4 Drawing Sheets

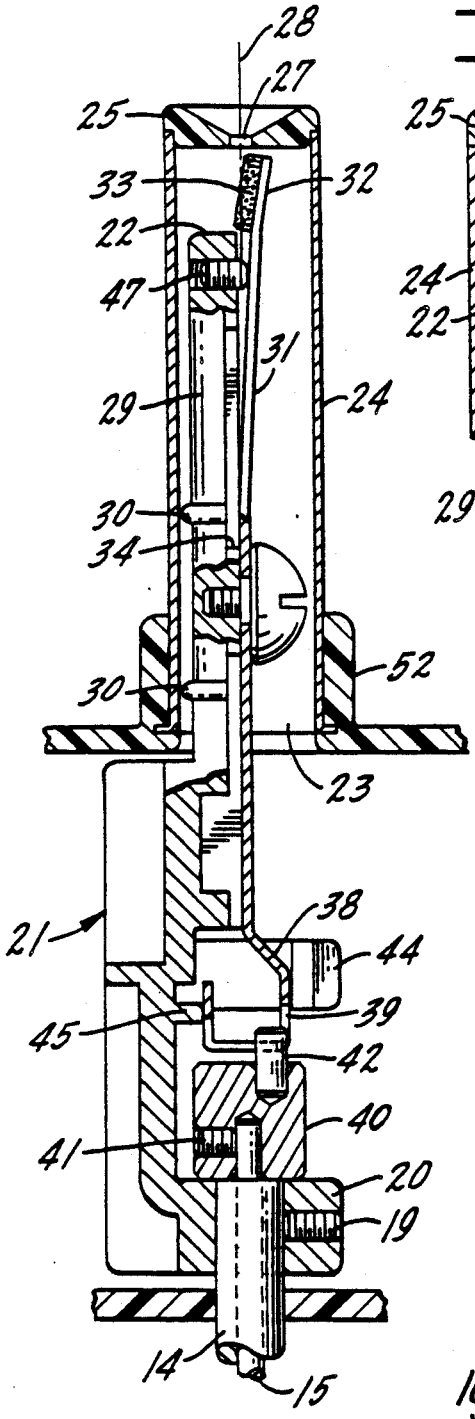
Fig.5.
Fig.6.
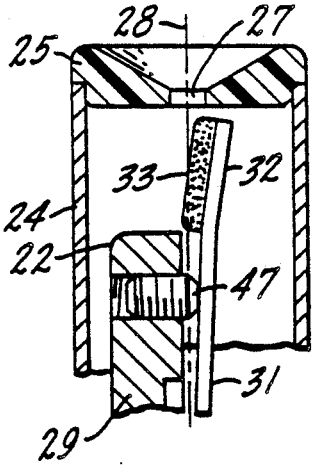
Fig.7.
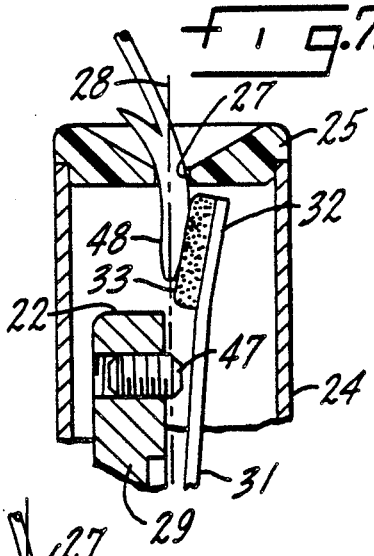
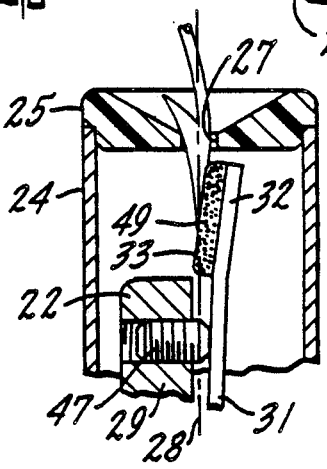
Fig.8.
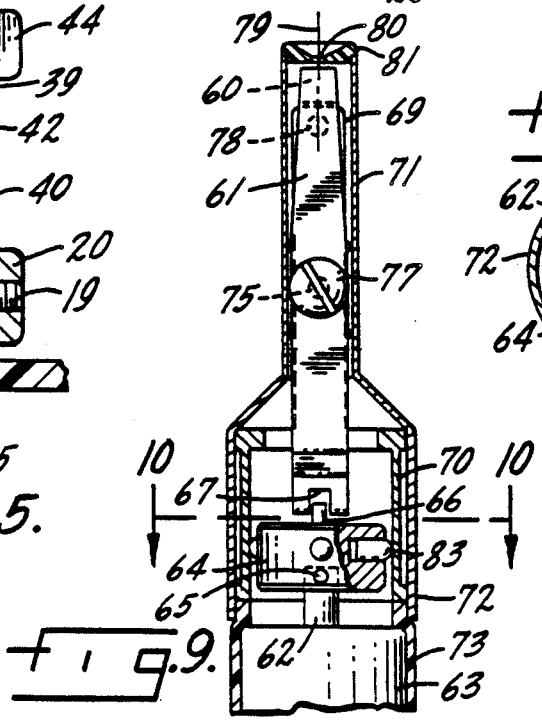
Fig.9.
Fig.10.
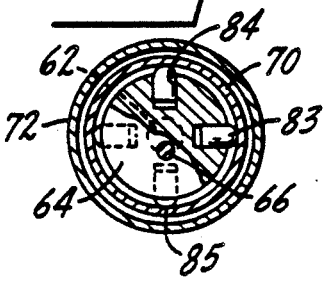

APPARATUS FOR SHARPENING POINTS

RELATED INVENTIONS

This application is a continuation-in-part and a division of U.S. patent application Ser. No. 176,213, filed on Mar. 31, 1988, now U.S. Pat. No. 4,869,028 which is a division of U.S. patent application Ser. No. 73,572, filed on July 15, 1987 now U.S. Pat. No. 4,879,844.

BACKGROUND OF THE INVENTION

This invention relates to the sharpening of pointed tools and objects such as scribers and punches, and fish hooks. Pointed tools are ordinarily given a reasonably sharp point when they are manufactured, but they usually become dull during usage and require honing to restore their sharpness. Also, skilled fishermen know that many more fish can be caught if the hooks they use have needle sharp points, but fish hooks are seldom manufactured with sufficiently sharp points.

Dull points have most often been sharpened manually with files, oilstones and grinding wheels. The points on scribers, punches and other relatively large tools can be sharpened on an electric bench grinder by spinning the tool manually against the flat side of the abrasive wheel, but great care must be taken to avoid overheating the extreme tip of the point so as to reduce its hardness. Also, the angle at which the point is held against the wheel and the speed at which it is rotated requires that the person doing the sharpening have a high degree of dexterity and experience. It is particularly difficult and time consuming to sharpen fish hooks. The shank tends to get in the way and under normal fishing conditions the light may be bad, the boat may rock, or the conditions encountered out of doors may be otherwise unfavorable for this task. The problems of honing fish hooks to a needle sharp point are compounded for treble hooks because of the difficulties in manipulating them. The result usually is that after a few tedious, time consuming, or unsuccessful efforts to get a needle sharp point, the fisherman gives up and fishes with dull hooks.

OBJECTIVES OF THIS INVENTION

Accordingly, it is an object this invention to provide improved apparatus and methods for producing needle sharp points.

Another object is to provide a portable sharpening tool that has a self contained power source.

Another object is to provide methods and apparatus for producing needle sharp points that do not require a person to have any special skill, experience, dexterity, or training.

Another object is to provide a very fast way to sharpen points.

Another object is to produce cone shaped points of adjustable angle on metal objects.

Another object is to provide a durable, relatively small, battery powered device that will sharpen a wide variety of tools and fish hooks in a short time without overheating their points.

Another object is to provide a portable, hand held, electrically powered sharpening tool that has its working parts enshrouded so that it can be used under normal and adverse fishing conditions to sharpen a lure with multiple treble hooks having various kinds of skirting material surrounding the hooks.

Another object is to produce sharp points with simplified methods and apparatus that are accurate, easily maintained, usable by either right or left handed people, and which do not possess defects or disadvantages of the prior art.

Other objects and advantages of the invention will be found in the specification and claims, and the scope of the invention will be set forth in the claims.

DESCRIPTION OF THE DRAWING

FIG. 5 is an enlarged, partially cross sectional side view of the moving parts of this embodiment.

FIGS. 6–8 are enlarged partially cross sectional views of the tip of this embodiment showing the sharpening of a fish hook.

FIG. 9 is a partially cross sectional schematic plan view of another embodiment of the invention.

FIG. 10 is a cross sectional view taken along the line 10—10 in FIG. 9.

DESCRIPTION OF THE INVENTION

Figure 1:
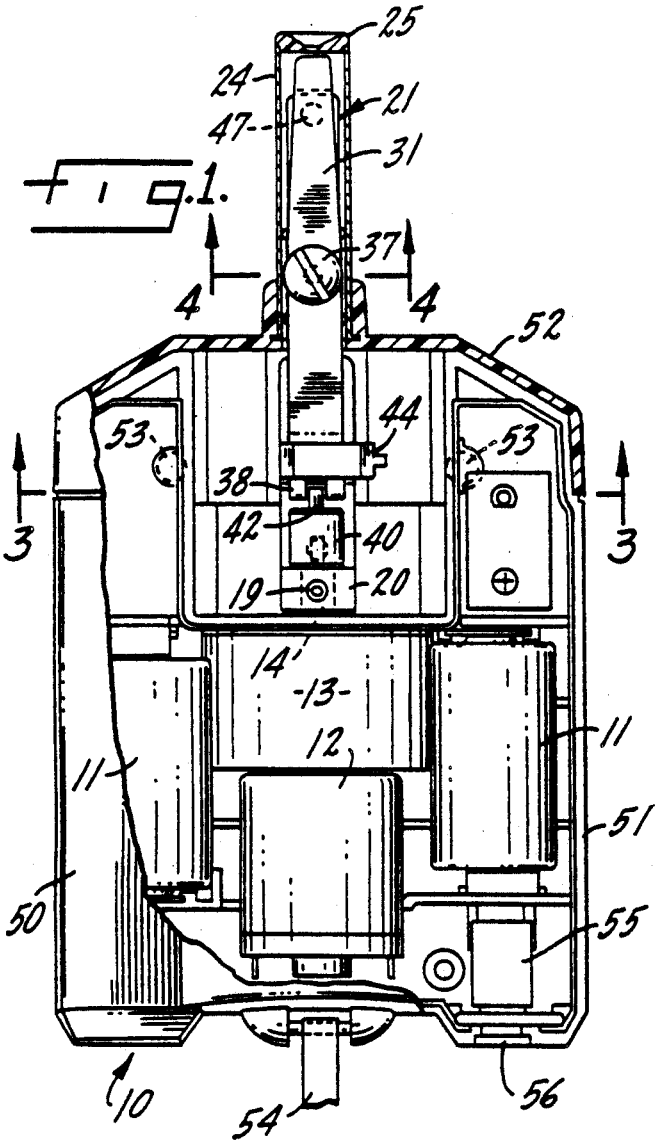
FIG. 1 is a partially broken away plan view of an embodiment of the invention.
Figure 2:
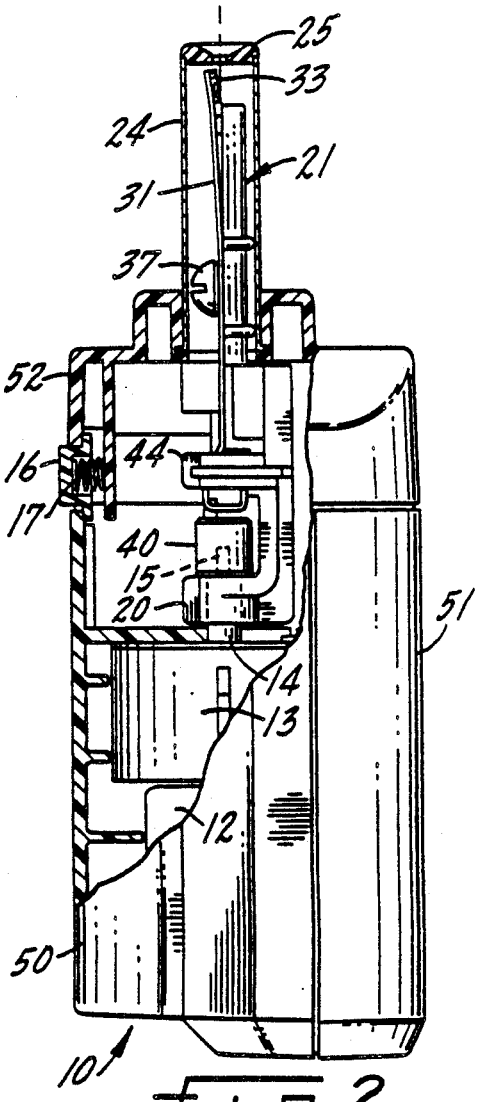
FIG. 2 is a partially broken away side view of the embodiment in FIG. 1.
Figure 3:
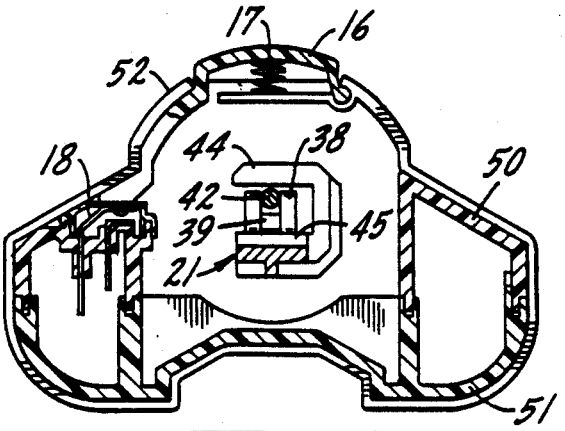
FIG. 3 is a cross sectional view taken along the line 3—3 in FIG. 1.
Figure 4:
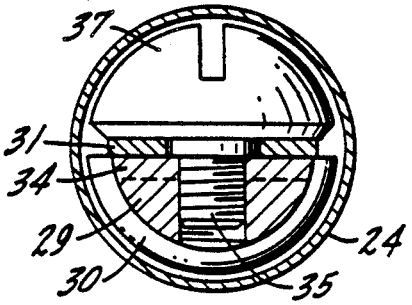
FIG. 4 is a cross sectional view taken along the line 4—4 in FIG. 1.

The drawing shows apparatus for honing needle sharp, cone shaped points on metal objects. The embodiment of FIGS. 1–8 is a portable hand held sharpener 10 that may be powered by a pair of 1.2 volt NiCad batteries 11 connected to a fractional h.p. D.C. motor 12 that makes 8,192 r.p.m. Motor 12 powers a conventional planetary gear box 13 from which emerge two coaxial shaft 14 and 15. Shaft 15 rotates at the same speed as motor 12 and may be an extension of the motor shaft, and shaft 14 rotates at a substantially slower speed than shaft 15 (e.g. 128 r.p. m. when gears 13 have a reduction ratio of 64 to 1). Motor 12 is activated by pressing a pivoted button 16 having a return spring 17 to close a switch 18 that completes the circuit connecting it to batteries 11 in conventional manner.

Shaft 14 is connected by a set screw 19 to one end 20 of a support bracket 21 for the assemblage of moving parts of this embodiment which rotates with the shaft. The other end 22 extends through the open end 23 of a cylindrical tube 24 projecting from the end cap 52 of sharpener 10. The other end of tube 24 is closed by an end surface 25 that has a center hole 27 centered on the central axis 28 of the tube, and bracket end 22 is spaced a short distance from hole 27. Bracket 21 has a relatively stiff hemi-cylindrical rod 29 that revolves freely in a circle in tube 24 and has curved bearing ridges 30 that contact the inside surface of the tube and space the rest of rod 29 from the tube. The inside of sharpener 10 is provided with appropriately located surfaces that align and support bracket 21 as it is rotated by shaft 14.

Bracket 21 supports and carries with it as it rotates, a pivoted shuttle 31. At one end 32 the shuttle has affixed to it a flat, non-loading metal honing abrasive surface or pad 33, such as ruby, diamond or cubic boron nitride, that is angled (e.g. 6 degrees) to central axis 28. Shuttle 31 is connected intermediate its ends to a circular shoulder 34 on circular rod 29 by a threaded pivot pin or stud 35 that holds the assembly together. Shoulder 34 spaces most of the shuttle away from rod 29 to reduce friction and wear. Stud 35 has a integral, slotted, hemispherical head 37 that bears against the other side of shuttle 31. The other end 38 of shuttle 31 is formed so as to define a slot 39. A rotary cylindrical cam 40 is attached at its central axis to shaft 15 by a set screw 41. An off center pin 42 on cam 40 protrudes into slot 39 and engages shuttle 31 as the cam is rotated at high speed by shaft 15. This causes both ends of shuttle 31 to reciprocate back and forth in opposite directions about stud 35, while the shuttle is carried by bracket 21 in a circular path around the central axis 28 of tube 24. A generally-L-shaped guide arm 44 extends from bracket 21 into contact with one side of end 38 of the shuttle for keeping the shuttle in proper alignment, and a ridge 45 on bracket 21 guides the other side of end 38. Shuttle 31 should be made from a flexible resilient metal such as stainless steel, and a threaded nib 47 that extends at a right angle to axis 28 adjacent end 22 of rod 29 flexes or urges the shuttle slightly away from rod 29 so as to pre-load the shuttle and abrasive surface 33 with a slight tension.

As shown in FIGS. 6–8, when no point is being honed, shuttle 31 contacts nib 47, and flat abrasive surface 33 intersects central axis 28 at a predetermined location determined by the extent to which nib 47 protrudes from rod 29. The entrance of hole 27 may be conically shaped to facilitate entry of a point 48, but the plane of hole 27 is considered to be the flat horizontal edge of end surface 25. When a dull point 48 is inserted through hole 27, it contacts abrasive surface 33 and flexes shuttle 31 to a greater degree, thus moving the shuttle out of contact with nib 47, as shown in FIG. 7. After dull point 48 has been inserted as far as it will go through hole 27, the axis of the dull point will approximately coincide with axis 28. When button 16 is pushed and motor 12 is energized, rotation of shaft 15 will cause flat abrasive surface 33 to a reciprocate at a high speed against dull point 48, and rotation of shaft 14 will cause abrasive surface 33 to be carried in a complete circle around point 48 at a slower speed. This will quickly hone away metal until a needle sharp conical point 49 is produced, as shown in FIG. 8, when the resiliency of the metal of shuttle 31 has moved it back toward or into contact with nib 47. In most cases it is not necessary for shuttle 31 to move all the way back into contact with nib 47 to hone a sharp point.

The location at which axis 28 contacts abrasive surface 33 can be varied, and hence the size and angle of conical point 49 can be adjusted, by threading nib 47 through rod 29 so that the extent to which the nib projects beyond the rod can be varied. The ability to vary the extent to which the nib 47 projects also permits the bending of shuttle 31 to change the angle at which abrasive surface 33 intersects axis 28, and thus to adjust the point produced by the sharpener. The action of nib 47 flexes shuttle 31 and thus preloads surface 33 by exerting a force on the shuttle at essentially a right angle to central axis 28. Instead of using a threaded nib 47, nib 47 may be held by friction in a hole in a rod 29 so that nibs of different lengths may be inserted and removed to adjust the spacing between shuttle 31 and rod 29.

The working parts of sharpener 10 may be contained in a three piece plastic housing having a pair of side pieces 50 and 51, and a top cap 52 that nest with each other and are secured in place by appropriately placed screws 53 in conventional manner. Suitable gaskets should be provided, and a wrist strap 54 may be hung on the outside. A conventional recharging jack 55, protected by a removable cover 56, should be connected into the electric circuit of sharpener 10 for recharging the batteries 11.

FIGS. 9 and 10 show another embodiment of the invention that is the same as the embodiment of FIGS. 1–8 in that an abrasive pad or surface 60 on one end of a pivoted shuttle 61 reciprocates as it is revolved in a circle around a point being sharpened. This embodiment differs from the embodiment of FIGS. 1–8 in that only one shaft 62 is driven by motor 63, and no gear box is needed. Shaft 62 turns at the relatively high speed of motor 63 and is connected to a revolving cam 64 by a set screw 65. An off center knob 66 on the cam enters a slot 67 at the other end of shuttle 61. A hemi-cylindrical rod 69 extends from a hollow support bracket 70 into a tube 71 on a removable end cap 72 of the housing 73. Bracket 70 is free to rotate in housing 73 and end cap 72. Shuttle 61 is connected to rod 69 by a threaded pivot pin or stud 75. An integral slotted hemispherical head 77 of stud 75 bears against the other side of shuttle 61 for supporting the shuttle and holding the assembly together. As described with reference to FIG. 6–8 nib 78 is threaded through rod 69 and protrudes from the rod so as to flex shuttle 671 and position abrasive surface 60 with respect to the central axis 79 of the center hole 80 of an end surface 81 that closes tube 71. Rotation of the single driven shaft 62 turns cam 64 and knob 66 and thus causes shuttle 61 to pivot about pin 75 and abrasive surface 60 to reciprocate at a high speed in the manner described previously with respect to FIGS. 1–8. In this embodiment slip clutch means, such as several sliding weights 83, is used to rotate support bracket 70 at a slower speed than shaft 63. Weights 83 are received in holes 84 that are symmetrically located in cam 64. As shaft 62 rotates can 64 at a high speed, centrifugal force slides the weights 83 away from the shaft until their ends 85 contact the inside surface of hollow support bracket 70. The sliding frictional engagement of ends 85 against the inside of bracket 70 drags the bracket and causes it to rotate at a much slower speed than cam 64 is rotating; this carries the reciprocating abrasive surface 60 in a complete circle around a point inserted through hole 80 and hones a needle sharp conical point on it.

Figure 11:
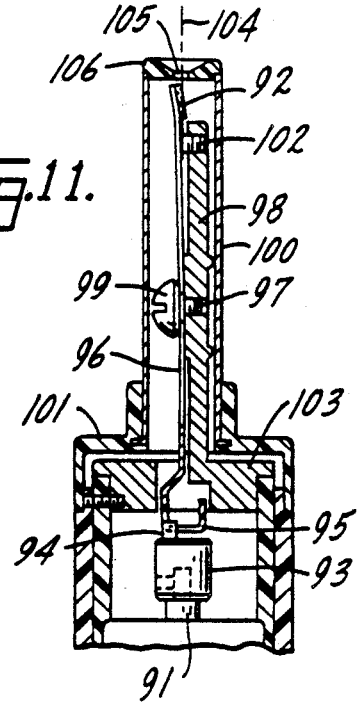
FIG. 11 is a schematic cross sectional view of another embodiment of the invention.
Figure 12:
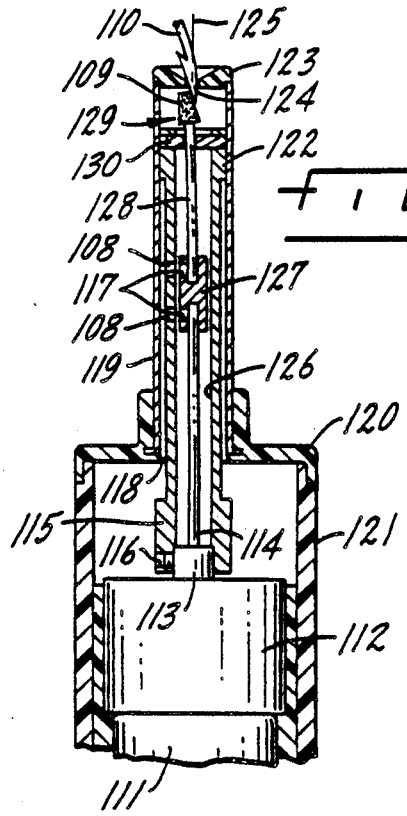
FIG. 12 is a schematic cross sectional plan view of another embodiment of the invention.
Figure 13:
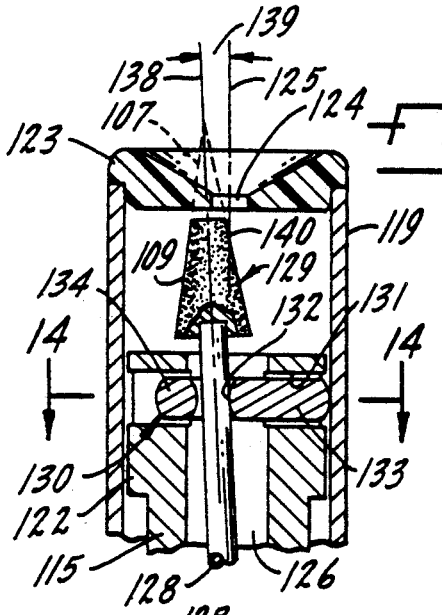
FIG. 13 is an enlarged cross sectional view of the tip of the embodiment of FIG. 12.

FIG. 11 shows another embodiment that requires only one motor driven shaft 91 to reciprocate abrasive surface 92, but in this embodiment the reciprocating surface does not rotate around a point being sharpened. Motor driven shaft 91 turns a cam 93 at a relatively high speed, and an off center knob 94 is received in a slot 95 at one end of a shuttle 96 that pivots about a threaded pin or stud 97. Shuttle 96 is positioned and supported by a hemi-cylindrical rod 98 that extends from a stationary support 103. An integral, slotted hemispherical head 99 of stud 97 holds the assembly together inside of a cylindrical tube 100 that extends from a removable end cap 101. A nib 102 threaded through block 98 extends beyond the block into contact with shuttle 96. Nib 102 positions and adjusts the abrasive surface 92 on the other end of the shuttle with respect to the central axis 104 of center hold 105 in end surface 106 in the same manner described with reference to FIG. 6–8. Rotation of shaft 91 turns cam 93, which causes shuttle 96 to pivot rapidly about pin 97 and reciprocates surface 92 adjacent hole 105. A point being sharpened by insertion through hole 105 should be manually rotated if a conical point is needed. If a many sided flat surfaced point is needed, the point should be inserted into hole 105, withdrawn when honed as much as will occur from that position of surface 92, turned and inserted again into hole 105. This procedure should be repeated until the point is sharpened to the specific shape required.

FIGS. 12–16 show other embodiments in which a circular abrasive surface 19 rotates, rather than reciprocates, as it is moved in a circle around a point 110 being sharpened. A conventional D.C. motor 111 controlled by a switch and energized by rechargeable NiCad batteries, as previously described, has a shaft that powers a conventional gear box 112. A pair of coaxial shafts 113 and 114 extend from the gear box, with shaft 113 rotating at a relatively slow speed and shaft 114 rotating at a higher speed. Shaft 113 is connected to one end of a hollow cylindrical support bracket 115 by a set screw 116. Bracket 115 extends into the open end 118 of a cylindrical tube 119 that projects from a removable end cap 120 on the sharpener housing 121, and has a circular bearing end collar 122 that centers the bracket in tube 119. An end surface 123 closes the other end of tube 119 and has a center hole 124 with a central axis 125 that coincides with the central axis of tube 119. Shaft 114, which may be an extension of the shaft of motor 111, passes through and rotates independently of shaft 113. Shaft 114 extends into the relatively large center passage 126 of bracket 115 where it is connected by a sleeve 127 to the shaft 128 of a honing burr 129. The truncated conical abrasive surface 109 of the burr defines an apex angle 107 of about twelve to fourteen degrees. Sleeve 127 couples burr 129 to shaft 114 so that the burr rotates at the same speed as shaft 114, but set screws 117 in the sleeve enable burr 129 to be removed and replaced when dull or when a different shaped point is needed. Holes 108 through bracket 115 provide access to set screws 117.

A square bearing 130 slides freely in a square channel 131 that passes through collar 122. Shaft 128 is guided by a relatively small off center bore 132 in bearing 130 that lines up with the larger passage 126 in bracket 115. Making bearing 130 and its channel 131 square in cross section prevents the bearing from twisting. One side 133 of bearing 130 is a predetermined distance longer than the other side 134 so that the terminal end 135 of side 134 will be in channel 131 out of contact with the inside surface of tube 119 when the terminal end 136 of side 133, is in contact with the inside of the tube. The length of side 133 is predetermined so that the central axis 138 of conical surface 109 is offset a predetermined distance 139 from central axis 125, which is tangent to surface 109 at 140; this also flexes shaft 128 slightly. It is intended that axes 125 and 138 be essentially parallel, but at times during the honing operation they may be only approximately parallel because of the flexing of shaft 128, and such flexing of shaft 128 will pre-load surface 109 for honing, as explained with reference to FIGS. 6–8.

Figure 15:
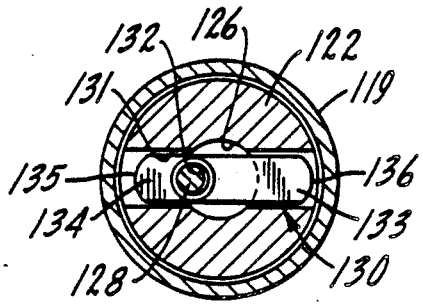
FIG. 15 is a cross sectional view corresponding to FIG. 14 showing the bearing in a deflected position.
Figure 14:
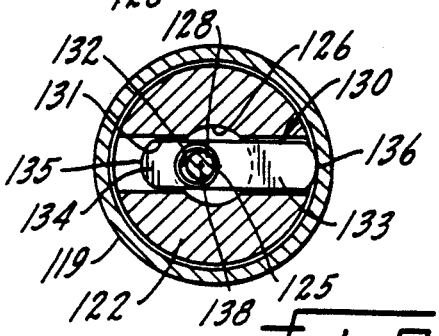
FIG. 14 is a cross sectional view taken along the line 14—14 in FIG. 13.

After motor 111 is energized, shaft 114 will rotate burr 129 at a high speed and shaft 113 will rotate bracket 115 at a slower speed. As bracket 115 rotates, the off center bore 132 in bearing 130 will move burr 129 in a circle around the central axis 125 of tube 119. When a point being sharpened is inserted through center hole 124, essentially the same action takes place as is illustrated in FIGS. 6–8 in that the dull point will contact the angled surface 109 of burr 129 and push the burr toward the inside surface of tube 119 by flexing shaft 128 as the center line of the dull point essentially coincides with center axis 125. Since bearing 130 is free to slide in channel 131 and since its end 135 terminates short of tube 119, end 135 can slide toward the tube innerwall as shaft 128 is flexed. This will move end 136 out of contact with tube 119, as shown in FIG. 15, and put an additional load on honing surface 109 as a result of the additional flexing of shaft 128. The forces resulting from flexing of shaft 128 will urge surface 109 back toward or to its original position where bearing end 136 is in contact with tube 119. This movement enables burr 129 to hone a needle sharp conical point on the dull point being sharpened even if bearing end 136 does not move all the way back into contact with tube 119. By changing the location of bore 132 in bearing 130 or by placing additional spaced bores 132 in bearing 130, the amount of metal that can be removed from the point being sharpened can be adjusted because such a change in location of bore 132 will change the location on abrasive surface 109 at which it is intersected by central axis 125. Changing the location of bore 132 may also be needed if the size or shape of burr 129 is changed. Such a change in the location of the intersection between surface 109 and axis 125 would result from the force of bearing 130 acting at essentially right angles to axis 125.

Figure 16:
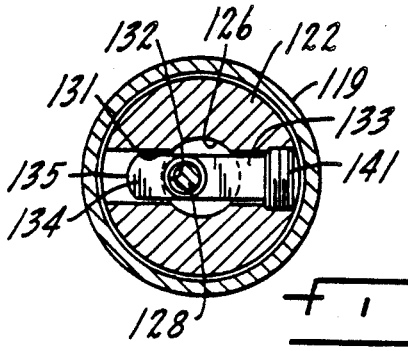
FIG. 16 is a cross sectional view corresponding to FIG. 14 showing another embodiment of the invention.

FIG. 16 shows another embodiment in which a set screw 141 has been threaded into a tapped hole at one end of channel 131, and end 133 has been shortened to accommodate the set screw. Advancing or retracting screw 141 changes the position of bore 132 and hence the location of abrasive surface 109 for the purposes described above. In other respects this embodiment is identical to that shown in FIGS. 12–15.

Figure 17:
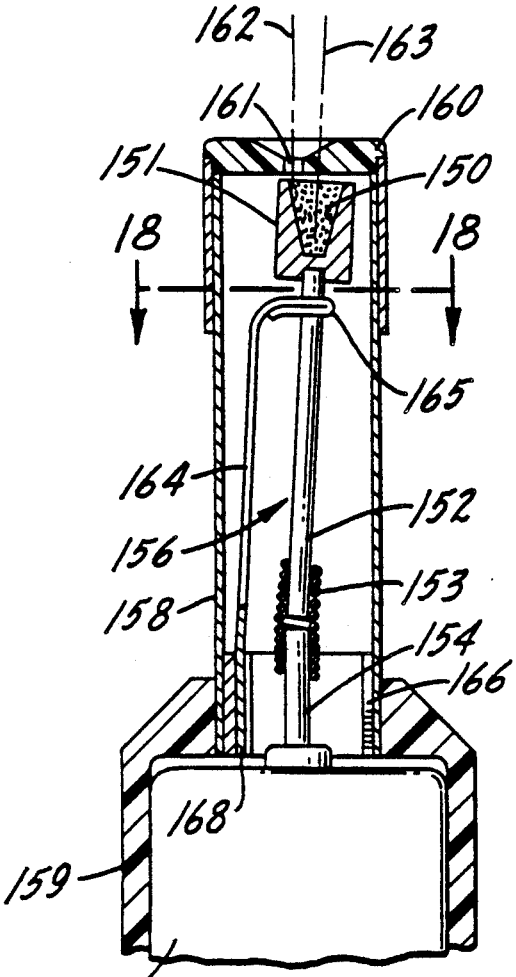
FIG. 17 is a schematic cross sectional plan view of another embodiment of the invention.
Figure 19:
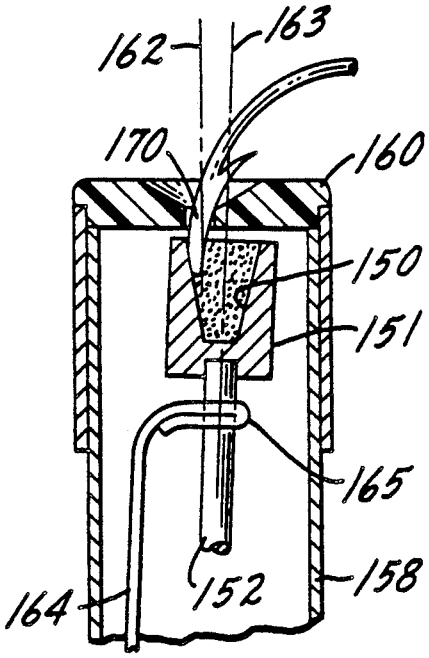
FIG. 19 is an enlarged partially cross sectional view of the tip of this embodiment showing the sharpening of a fish hook.
Figure 18:
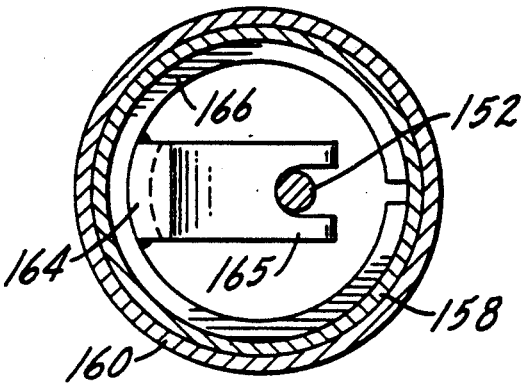
FIG. 18 is an enlarged cross sectional view taken along the line 18—18 of FIG. 17.

FIGS. 17–19 show another embodiment of a portable, hand-held automatic hone in which a point is sharpened by a rotating conical abrasive surface 150 on a cup shaped burr or member 151, which is attached to an outer end of a shaft segment 152. Segment 152 is coupled by a resilient coil spring 153 to the shaft 154 of an electric motor 155. The opposed ends of segment 152 and shaft 154 may be inserted into and removed from spring 153. Shaft segment 152, motor shaft 154 and coil spring 153 define resilient flexible shaft means 156 for rotating surface 150, and such shaft means 156 may be replaced by a single motor driven shaft having the same characteristics. Motor 155 should be battery powered, as explained above with regard to other embodiments. Shaft means 156 extends into the open end of a cylindrical tube 158 that protrudes from housing member 159. An end cap 160 closing the opposite end of tube 158 has a small hole 161 at its center, and the central axis 162 of hole 161 is coaxial with the central axis of tube 158 and motor shaft 154. The central axis 163 of abrasive surface 150 is coaxial with the central axis of shaft segment 152. A resilient flexible yoke member 164 having a bifurcated end 165 captures shaft segment 152 below member 151 and is removable held in tube 158 by a split ring 166 to which its other end 168 is attached. To hold yoke member 164 in proper position, ring 166 expands against the inside surface of tube 158 at its open end. Shaft segment 152 rotates between the bifurcations of end 165. Yoke member 164 urges axis 163 of segment 152 and surface 150 away from axis 162 by bending spring coupling 153 so that axes 162 and 163 intersect. This pre-loads abrasive surface 150 with flexed material tension as explained previously with regard to other embodiments. Abrasive surface 150 also intersects axes 162 and 163. When a dull point 170 being sharpened is inserted through hole 162 as shown in FIG. 19, its central axis is essentially aligned with axis 162. The point contacts abrasive surface 150 and pushes against surface 150. This urges shaft segment 152 against the resilience of yoke member 164 and moves axis 163, segment 152, and surface 150 toward the center of tube 158 and more closely to being aligned with axis 162. The energizing of motor 155 causes rotation of shaft means 156 and rotation of abrasive surface 150 against point 170. Material is honed off point 170 as it is being sharpened and the resilience of yoke member 164 urges shaft segment 152 back towards its initial position with axes 162 and 163 further from alignment. Use of cup shaped abrasive member 151 makes it easier to keep point 170 in contact with abrasive surface 150 because the point is captured within the abrasive member, and movement of axis 163 toward the center of tube 158 during the sharpening operation prevents member 151 from contacting the inner surface of tube 158. Cup shaped member 150 also may have a cylindrical abrasive inside surface. Also, by sharpening point 170 inside of cup shaped member 151, the metal powder and particles resulting from the honing operation are caught within member 151 and thus prevented from falling on moving parts of the apparatus.

The invention also includes methods of honing. In one method a dull metal point 48 is positioned in a predetermined location by center hole 27 in surface 25 with the central axis of the point being essentially coincident with the central axis 28 of the hole. Point 48 is moved into contact with a flat abrasive surface 33 and then held stationary. Abrasive surface 33 is reciprocated by the action of shuttle 31 while it is in contact with point 48. The reciprocating surface 33 is moved in a complete circle around point 48 by the action of shaft 14 on bracket 21. The nib 47 flexes shuttle 31 and thus urges abrasive surface 33 against point 48 under flexed metal tension. The distance nib 47 protrudes from rod 29 controls the maximum amount of metal that can be removed from point 48.

In another method, a dull point such as 48 would be positioned with its central axis in a predetermined location, such as essentially coincident with axis 125, and then moved into contact with conical abrasive surface 109 and held stationary, so that its central axis is approximately parallel with axis 138 of the conical surface. Conical surface 109 is then rotated around its central axis 138 while the central axis 138 is rotated in a complete circle around the central axis 125 of the metal point. The action of bearing 130 flexes shaft 128 and this urges conical abrasive surface 109 against the dull metal point under flexed metal tension. By keeping axes 125 and 138 generally parallel, the size of the apparatus used to carry out the method is reduced and such apparatus is greatly simplified.

In another method, a conical point is honed by moving an abrasive surface 33 or 109, mounted on a flexible support 31 or 128, against a metal point. The metal point is held in place in a hole 27 or 124 while the moving surface 33 or 109 is rotated completely around the metal point. The metal point creates tension against the abrasive surface 33 or 109 by flexing the shaft 31 or 128. The amount of metal removed from the point can be adjusted by changing the location at which the surface 33 or 109 intersects the central axis 28 or 125 of the hole in which the point is held, and this can be accomplished by using nib 47 or bearing 130 to exert a force on flexible support 31 or 128 at essentially a right angle to central axis 28 or 125.

It has thus been shown that by the practice of this invention needle sharp points can be quickly honed on a metal implement without requiring the person doing the honing to have any special skills or experience. The devices disclosed are portable and can be used out of doors, and they operate automatically. All moving parts are enclosed, which protects the parts from adverse outdoor conditions and protects the user from harm from contact with the parts. Treble fish hooks can be honed quickly without subjecting the person doing the sharpening to the danger of being impaled on one of the hooks.

While the present invention has been described with reference to a particular embodiment, it is not intended to illustrate or describe herein all of the equivalent forms or ramifications thereof. For example, batteries that are not rechargeable could be used, or a separate motor could be used to power each of the shafts in the two shaft embodiments, or a wind-up spring motor could be used instead of an electric motor. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. Apparatus for sharpening a metal point having a central axis comprising:

A. means for positioning said metal point with its central axis in a predetermined location;

B. first shaft means having a curved abrasive surface adjacent one of its ends, said curved abrasive surface having a central axis and said central axis of said curved abrasive surface being coaxial with said first shaft means; and C. a motor driving said first shaft means so as to rotate said abrasive surface at a first speed, said motor driving second shaft means so as to revolve said abrasive surface around said metal point at a second speed that is slower than said first speed, and said first and second shaft means being coaxial.

2. Apparatus for sharpening a metal point having a central axis, comprising:

A. means for positioning said metal point with its central axis in a predetermined location;

B. first shaft means having a curved abrasive surface adjacent on of its ends, said curved abrasive surface having a central axis and said central axis of said curved abrasive surface being coaxial with said first shaft means; and C. a motor driving said first shaft means so as to rotate said abrasive surface at a first speed, said motor driving second shaft means so as to revolve said abrasive surface around said metal point at a second speed that is slower than said first speed, and said first shaft means passing through and rotating independently of said second shaft means.

3. The invention defined in claim 1, wherein said means for positioning said metal point comprises a tube having a surface closing one of its ends, a hole centered in said surface, a bearing for said first shaft means in said tube adjacent its closed end, and said curved abrasive surface being located between said bearing and said hole.

4. The invention defined in claim 1, wherein said first shaft means is flexible, and upon insertion of said point into said hole, said point engages said abrasive surface and flexes said shaft means slightly so as to urge said abrasive surface against said metal point.

5. Apparatus for sharpening a metal point having a central axis, comprising:

A. means for positioning said metal point with its central axis in a predetermined location comprising a tube having a central axis and having a surface closing one of its ends, a hole centered in said surface, a bearing for said first shaft means in said tube adjacent its closed end, said bearing being slidable in a channel that extends at right angles to said central axis of said tube;

B. first shaft means having a curved abrasive surface adjacent one of its ends said curved abrasive surface having a central axis and said central axis of said curved abrasive surface being coaxial with said first shaft means; and C. a motor driving said first shaft means so as to rotate said abrasive surface at a first speed, and said motor driving second shaft means so as to revolve said abrasive surface around said metal point at a second speed that is slower than said first speed.

6. The invention defined in claim 5, further comprising threaded means for adjusting the location of said bearing in said channel.

7. Apparatus for sharpening a metal point having a central axis, comprising:

A. means for positioning said metal point with its central axis in a predetermined location comprising a tube having a surface closing one of its ends, a hole centered in said surface, a bearing for said first shaft means in a channel in said tube adjacent its closed end, said curved abrasive surface being located between said bearing and said hole, and cylindrical support bracket rotatable in said tube, said channel and said bearing being in said bracket;

B. flexible first shaft means having a curved abrasive surface adjacent one of its ends, said surved abrasive surface having a central axis and said central axis of said curved abrasive surface being coaxial with said first shaft means, upon insertion of said point into said hole, said point engaging said abrasive curved surface and flexing said shaft means slightly so as to urge said curved abrasive surface against said metal point; and C. a motor driving said first shaft means so as to rotate said abrasive surface at a first speed, and said motor driving second shaft means so as to revolve said abrasive surface around said metal point at a second speed that is slower than said first speed.

8. The invention defined in claim 7, wherein said channel and said bearing are rectangular in cross section.

9. The invention defined in claim 1, wherein said curved abrasive surface has a central axis that intersects said central axis of said metal point, and said central axis of said metal point is coaxial with said first and second shaft means while said metal point is being sharpened.

10. Apparatus for sharpening a point comprising:

A. a cylindrical tube having a closed end with a center hole therethrough having its axis coaxial with said tube, said hole being adapted to receive a point being sharpened and to position said point essentially on said axis;

B. a circular member rotatably housed in said tube, the end of said circular member being spaced from said center hole, said circular member having a central passage that is coaxial with said center hole, and means for rotating said circular member in said cylindrical tube;

C. a rotatable flexible shaft passing through said central passage and having an end extending into the space between said end of said circular member and said hole, the diameter of said shaft being smaller than said central passage, an abrasive surface on said end of said shaft, and means for rotating said shaft; and D. means for moving said abrasive surface around a point to be sharpened that has been inserted through said center hole into said space comprising:

1. a channel through said circular member adjacent its end, said channel being perpendicular to said central passage, 2. a bearing slidable in said channel, said bearing having a bore therethrough that is generally aligned with said central passage, said shaft passing through said bore in rotating contact with said bearing, and said bore being located closer to one end of said bearing than its other end so that said one end terminates within said channel in spaced relation to the inside surface of said tube and said other end of said bearing extends beyond said bore into contact with said inside surface of said tube, whereby said bearing moves said shaft away from the said axis of said hole and carries said shaft around said axis when said circular member is rotated.

11. The invention defined in claim 10, further comprising means rotating said circular member at a speed slower than the speed at which said shaft is rotated.

12. The invention defined in claim 10, further comprising said channel and said bore being rectangular.

13. The invention defined in claim 10, further comprising the center of said bore being located in sufficient distance from said axis to flex said shaft and thereby to create a force urging said abrasive surface against said point.

14. The invention defined in claim 10, further comprising said one end of said bearing being spaced sufficiently from said inside surface of said cylinder to permit said point to further flex said shaft as said point is moved into contact with said abrasive surface.

15. The invention defined in claim 10, further comprising means threaded into said channel for varying the location of said bore with respect to said central passage.

16. A hand held, portable, battery-powered electric tool for honing a needle sharp point on a pointed metal object, comprising: a housing enclosing within its interior an electric motor, a battery for running said motor within said interior of said housing, said housing having an exterior end surface, a hollow tube having an open end attached to said housing so that the hollow interior of said tube communicates with the interior of said housing, an opposite end of said tube extending beyond said exterior end surface of said housing, said opposite end of said tube being closed by an end member that faces away from said interior of said housing, said end member having a small hole extending therethrough and communicating with said interior of said tube, shaft means extending from said interior of said housing into said interior of said tube, said shaft means having one of its ends operatively connected to said electric motor on the interior of said housing, said shaft means having a honing surface for sharpening said point adjacent its opposite end on the inside of said tube next to said small hole, said shaft means positioning said honing surface in said tube beyond said exterior surface of said housing, said point being inserted from outside of said tube through said small hole past said end member into said interior or said tube and into contact with said honing surface for sharpening, said electric motor moving said shaft means and said honing surface while said honing surface is in contact with said point so that said honing surface sharpens said point outside of said housing.

17. The invention defined in claim 16, wherein said metal object is a fish hook having a point on a terminal end that has a central axis, said fish hook having a bend that curves away from said central axis of said point, said tube and said small hole having coincident central axes, and said central axis of said point being aligned with said central axes of said small hole and said tube when said honing surface is in contact with said point outside of said housing.

18. A hand-held, portable, battery-operated electric tool for honing a needle sharp point on a pointed metal object, comprising: a housing enclosing an electric motor, and a battery for running said motor within its interior, a hollow tube having an open end attached to said housing so that its interior communicates with said interior of said housing, an opposite end of said tube extending beyond said housing, said opposite end being closed except for a small hole extending there-through and communicating with said interior of said tube, resilient shaft means in said tube being operatively connected to said electric motor adjacent one end and having a honing surface for sharpening said point adjacent its other end within said tube adjacent said opening, said point being inserted through said opening into said interior of said tube and into contact with said honing surface for sharpening, insertion of said point against said honing surface causing flexing of said shaft so as to move said honing surface from an initial position and producing flexed material tension for holding said honing surface against said point while said point is being sharpened, said electric motor moving said honing surface while it is in contact with said point so as to sharpen said point, and means for adjusting the degree to which said shaft means is flexed.

19. The invention defined in claim 16, wherein said tube and said small hole have coincident central axes, and said shaft means has a central axis that is coincident with said central axes at said open end.

20. The invention defined in claim 16 wherein said honing surface is rotated while in contact with said point.

21. The invention defined in claim 17, wherein said tube is a circular cylinder having a diameter of predetermined length, said housing has a predetermined minimum cross sectional dimension, and said length of said diameter is less than said minimum cross sectional dimension of said housing.

22. The invention defined in claim 19, wherein said shaft means is resilient and insertion of said point into contact with said honing surface moves said opposite end of said shaft means away from said central axes of said tube and small hole so as to produce flexed material tension in said shaft means for holding said honing surface in contact with said point while it is being sharpened.

23. A hand-held, portable, battery-powered electric tool for honing a needle sharp point on a pointed metal object, comprising: a housing enclosing an electric motor, and a battery for running said motor within its interior, a hollow tube having an open end attached to said housing so that its interior communicates with said interior of said housing, an opposite end of said tube extending beyond said housing, said opposite end being closed except for a small hole extending there-through and communicating with said interior of said tube, said small hole having a central axis, flexible shaft means in said tube being operatively connected to said electric motor adjacent one end and having a honing surface for sharpening said point adjacent its other end within said tube adjacent said opening, said point being inserted through said opening into said interior of said tube and into contact with said honing surface for sharpening, said electric motor moving said honing surface while it is in contact with said point so as to sharpen said point, and said honing surface having an initial position with respect to said central axis, insertion of said point through said small hole into contact with said abrasive surface flexing said shaft means and moving said honing surface from said initial position toward said central axis.

24. Apparatus for sharpening a fish hook having a point on a terminal end that has a central axis, and said fish hook having a bend that curves away from its central axis, comprising:

A. a hollow tube having a central axis that passes through its interior, said tube having a terminal end that is closed by an end member having one surface facing the inside of said tube and an opposite surface facing away from said inside of said tube, there being a small hole through said end member, said small hole being centered on said central axis of said tube, and an opposite end of said tube being open;

B. shaft means having one end passing through said open end of said tube into said interior of said tube, said shaft means having an abrasive surface at its opposite end located on the inside of said tube adjacent said one surface of said end member;

C. said point of said fish hook passing from outside of said tube through said small hole into said interior of said tube, said point contacting said abrasive surface on the inside of said tube adjacent said one surface of said end member, and said fish hook being supported by said end member with its central axis coincident with said central axis of said tube, and said bend curving away from said opposite surface of said end member and said central axis of said tube; and D. means for rotating said abrasive surface on the inside of said tube while said abrasive surface is in contact with and is sharpening said fish hook point.

25. The invention defined in claim 24, wherein said shaft means has a central axis that is coincident with said central axis of said tube where said one end of said shaft means passes through said open end of said tube into said interior of said tube.

26. The invention defined in claim 24 wherein said shaft means in resilient and said opposite end has an initial position when said abrasive surface is out of contact with said point, and insertion of said fish hook point into contact with said abrasive surface moves said abrasive surface and said opposite end to a position different from said initial position so as to produce flexed material tension in said shaft means for holding said abrasive surface against said fish hook point while it is being sharpened.

27. The invention defined in claim 1, wherein said first and second shaft means rotate independently of each other.

28. The invention defined in claim 19, wherein said shaft means is resilient and insertion of said point into contact with said honing surface moves said opposite end of said shaft means toward said central axes of said tube and small hole so as to produce flexed material tension in said shaft means for holding said honing surface in contact with said point while it is being sharpened.

29. Apparatus for honing a needle sharp point on pointed metal objects, said point having a central axis, and said apparatus comprising: an electric motor and a battery for running said electric motor, tubular means having a central axis, said tubular means having an open end and an opposite end that is closed except for a small hole that has a central axis, rotatable shaft means having a central axis and extending into said tubular means said shaft means having one end that terminates inside of said tubular means adjacent said small hole, an opposite end of said shaft means being connected to said electric motor and being rotatable thereby, honing means on said one end of said shaft means for contacting a pointed metal object and sharpening said pointed metal object after insertion of said pointed metal object through said small hole into said tubular means, said central axes of said point, said tubular means, and said small hole being coincident, and said central axis of said shaft means also being coincident with said central axes at said opposite end.

30. The invention defined in claim 29, wherein said shaft means is resilient and insertion of said pointed metal object through said small hole into contact with said honing means flexes said shaft means and moves said honing means away from an initial position, and such flexing produces flexed material tension for holding said honing means against said pointed metal object while it is being sharpened.

31. The invention defined in claim 30, wherein said tension moves said honing means back toward said initial position as said point is sharpened.

32. The invention defined in claim 29, wherein said shaft means comprises first and second shaft segments and said segments are coupled by coil spring means.

33. The invention defined in claim 29, wherein said honing means is an abrasive burr having a central axis which intersects said central axis of said small hole.

34. Apparatus for honing a needle sharp point on pointed metal objects, comprising: an electric motor and a battery for running said electric motor, tubular means having an open end and an opposite end that is closed except for a small hole that has a central axis, rotatable resilient shaft means extending into said tubular means and having an unattached freely movable end that terminates inside of said tubular means adjacent said small hole, an opposite end of said shaft means being connected to said electric motor and being rotatable thereby, an open cup shaped abrasive burr having a central axis which intersects said central axis of said small hole, said burring being on said unattached freely movable end of said shaft means for contacting a pointed metal object and sharpening said pointed metal object after insertion of said pointed metal object through said small hole into said tubular means, such insertion of aid pointed metal object through said small hole into contact with said burr flexing said shaft means and moving said burr away from an initial position, and such flexing producing flexed material tension for holding said burr against said pointed metal object while it is being sharpened.

35. Apparatus for honing a needle sharp point on pointed metal objects, comprising: an electric motor and a battery for running said electric motor, tubular means having an open end and opposite end that is closed except for a small hole that has a central axis, rotatable resilient shaft means extending into said tubular means and having an unattached freely movable end that terminates inside of said tubular means adjacent said small hole, an opposite end of said shaft means being connected to said electric motor and being rotatable thereby, an abrasive burr having a central axis which intersects said central axis of said small hole, said burr being on said unattached freely movable end of said shaft means for contacting a pointed metal object and sharpening said pointed metal object after insertion of said pointed metal object through said small hole into said tubular means, such insertion of said pointed metal object through said small hole into contact with said burr flexing said shaft means and moving said burr away from an initial position, and such flexing producing flexed material tension for holding said burr against said pointed metal object while it is being sharpened, and said flexing of said shaft means by insertion of said pointed metal object moving said central axis of said burr toward said central axis of said small hole.

36. The invention defined in claim 22, wherein said burr has a conical shape.

37. The invention defined in claim 30, wherein said flexing of said shaft means by said pointed metal object moves said central axis of said burr away from said central axis of said small hole.

38. The invention defined in claim 22, wherein said burr has a cylindrical shape.

39. Apparatus for honing a needle sharp point on pointed metal objects, comprising: an electric motor and a battery for running said electric motor, tubular means having an open end and opposite end that is closed except for a small hole that has a central axis, rotatable resilient shaft means extending into said tubular means and having an unattached freely movable end that terminates inside of said tubular means adjacent said small hole, an opposite end of said shaft means being connected to said electric motor and being rotatable thereby, honing means on said unattached freely movable end of said shaft means for contacting a pointed metal object and sharpening said pointed metal object after insertion of said pointed metal object through said small hole into said tubular means, such insertion of said pointed metal object through said small hole into contact with said honing means flexing said shaft means and moving said honing means away from an initial position, and such flexing producing flexed material tension for holding said honing means against said pointed metal object while it is being sharpened, and resilient yoke means having a bifurcated end contacting said shaft means and urging said shaft means to said initial position.

40. The invention defined in claim 39, wherein said yoke means has an end opposite to said bifurcated end that is attached to split ring means that expands against an inside surface of said tubular means for holding said yoke means in operating position.

41. The invention defined in claim 29, wherein said shaft means comprises a shaft extending directly from said electric motor, and said shaft of said electric motor being coaxial with the previously mentioned axes.

* * * * *